US005468626A

United States Patent [19]

Johnson et al.

[11] Patent Number: 5,468,626

[45] Date of Patent: Nov. 21, 1995

[54] METHOD FOR SEPARATING A SULFUR COMPOUND FROM CARBONACEOUS MATERIALS

[75] Inventors: Steven W. Johnson; Daniel J. Monticello; Phillip R. Gibbs, all of The Woodlands, Tex.; Charles F. Kulpa, Niles, Mich.

[73] Assignees: Energy BioSystems Corporation, The Woodlands, Tex.; University of Notre Dame, Notre Dam, Ind.

[21] Appl. No.: 169,433

[22] Filed: Dec. 17, 1993

[51] Int. Cl.[6] ..... C12P 11/00; C12P 3/00; C10G 32/00

[52] U.S. Cl. ..... 435/130; 435/168; 435/170; 435/281; 435/282; 435/822

[58] Field of Search ..... 435/822, 281, 435/282, 168, 170, 130

[56] References Cited

U.S. PATENT DOCUMENTS

| | | | |
|---|---|---|---|
| 4,085,972 | 4/1978 | Ghosti | 299/7 |
| 4,184,547 | 1/1980 | Klass et al. | 299/7 |
| 4,687,585 | 8/1987 | Ramshaw | 210/787 |
| 5,002,888 | 3/1991 | Kilbane, II | 435/242.31 |
| 5,104,801 | 4/1992 | Kilbane, II | 435/282 |
| 5,132,219 | 7/1992 | Kilbane, II | 435/195 |
| 5,198,341 | 3/1993 | Kilbane, II | 435/42 |
| 5,232,854 | 8/1993 | Monticello | 435/282 |
| 5,356,801 | 10/1994 | Rambosek et al. | 435/195 |
| 5,358,870 | 10/1994 | Monticello et al. | 435/282 |

OTHER PUBLICATIONS

Bohonos, N. et al., "Some Observations on Biodegradation of Pollutants in Aquatic Systems", *The Japanese Journal of Antibiotics,* vol. XXX Suppl.:S–275–S285 (1977).

Bell, John P. and Tsezos, Marios, "Removal of hazardous organic pollutants by biomass adsorption", *Journal WPCF,* 59(4):191–198 (1987).

Steen, William C. and Karickhoff, Samuel W., "Biosorption of Hydrophobic Organic Pollutants by Mixed Microbiol Populations", *U.S. Environmental Protection Agency,* Environmental Research Laboratory, Athens, Ga. 30613, pp. 27–32 (1980).

Fujie, Kotchi et al., "A Simplified Kinetic Model to Simulate Soluble Organic Substances Removal in an Activated Sludge Aeration Tank", *Wat. Res.* 22(1):29–36 (1988).

Omori, Toshio et al., "Desulfurization of Dibenzothiophene by Corynebacterium sp. Strain SY1", *Applied and Environmental Microbiology,* 58(3):911–915, (1992).

Kim, Hao Yeong et al., "Degradation of Organic Sulfur Compounds and the Reduction of Dibenzothiophene to Biophenyl and Hydrogen Sulfide by *Desulfovibrio desulfuricans M6", Biotechnology Letters,* 12(10):761–764, (1990).

*Primary Examiner*—Herbert J. Lilling

*Attorney, Agent, or Firm*—Hamilton, Brook, Smith & Reynolds

[57] ABSTRACT

The present invention relates to a method for separating a sulfur compound from a fossil fuel containing sulfur compounds comprising contacting said fossil fuel with a biosorption agent which binds said sulfur compound, thereby forming a sulfur-biosorption complex and separating said sulfur-biosorption complex. The method can further include introducing said separated sulfur biosorption complex to an aqueous phase having an effective amount of oxygen and water to form a reaction medium, optionally adding a biocatalyst which degrades the sulfur compound; incubating the medium for a sufficient period of time to produce an organic product, an inorganic sulfur and spent biocatalyst; and isolating said biosorption agent and/or biocatalyst from said organic product and said inorganic sulfur. The invention also relates to the preparation of the products of the oxidation reaction of organic sulfur compounds by a biocatalyst, such as 2-hydroxybiphenyl compounds.

17 Claims, No Drawings

METHOD FOR SEPARATING A SULFUR COMPOUND FROM CARBONACEOUS MATERIALS

BACKGROUND OF THE INVENTION

Sulfur is an objectionable element that is typically found in fossil fuels, where it occurs both as inorganic sulfur, such as pyritic sulfur, and as organic sulfur, such as a sulfur atom or moiety present in a wide variety of hydrocarbon molecules, including for example, mercaptans, disulfides, sulfones, thiols, thioethers, thiophenes, and other more complex forms. Crude oils can typically contain, for example, amounts of sulfur up to 5 wt % or more.

The presence of sulfur in fossil fuels has been correlated with the corrosion of pipeline, pumping, and refining equipment, and with the premature breakdown of combustion engines. Sulfur also contaminates or poisons many catalysts which are used in the refining and combustion of fossil fuels. Moreover, the atmospheric emission of sulfur combustion products, such as sulfur dioxide, leads to the form of acid deposition known as acid rain. Acid rain has lasting deleterious effects on aquatic and forest ecosystems, as well as on agricultural areas located downwind of combustion facilities. To counter these problems, several methods for desulfurizing fossil fuels, either prior to or immediately after combustion, have been developed.

One recently developed technique for desulfurizing fossil fuels is known as biodesulfurization (BDS). BDS is generally described as the harnessing of metabolic processes of suitable bacteria to the desulfurization of fossil fuels. Thus, BDS typically involves mild conditions, such as ambient or physiological temperature and pressure, and does not involve the extremes of temperature and pressure associated with conventional desulfurization technologies. Kilbane, U.S. Pat. No. 5,104,801 describes one such process wherein a mutant *Rhodococcus rhodochrous* strain ATCC No. 53968 selectively cleaves the C—S bond in organic carbonaceous materials.

SUMMARY OF THE INVENTION

The present invention relates to a method for the separation of a sulfur compound from a fossil fuel containing sulfur compounds comprising contacting said fossil fuel with a biosorption agent which binds said sulfur compound, thereby forming a sulfur-biosorption complex and separating said sulfur-biosorption complex.

The method can further include introducing said separated sulfur-biosorption complex to an aqueous phase having an effective amount of oxygen and water to form a reaction medium; if appropriate, adding a biocatalyst capable of desulfurizing fossil fuel; incubating the medium for a sufficient period of time to produce an organic product, an inorganic sulfur product and spent biocatalyst; and, optionally, separating said biosorption agent and/or biocatalyst, said organic product and said inorganic sulfur.

The invention also relates to the preparation of products of the oxidation reaction of an organic sulfur compound by a biocatalyst, e.g., 2-hydroxybiphenyl compounds.

This invention provides several advantages. One advantage of this method is that the process of desulfurizing petroleum can be achieved in a non-aqueous environment, reducing costly separation steps subsequent to the biodesulfurization step and reducing loss of water soluble components of the fuel. The removal of sulfur can also, advantageously, be performed in the absence of oxygen or air, which is detrimental to some fuels. Oxygen can cause gum formation or polymerization of some materials found in fossil fuels. Aerating will generally cause a loss of volatile organic compounds. In some case, aerating a hydrocarbon liquid could cause severe explosion potential (gasoline fractions, for example) or safety problems. The sulfur-biosorption complex can be easily separated from the petroleum, resulting in a petroleum fraction with a low sulfur content. Subsequent to removal of the complex from the petroleum fraction, the sulfur can be biocatalytically cleaved from the organic compound in an environment optimal for the biocatalyst. The biosorption agent and/or biocatalyst can then be easily separated and reused. Furthermore, the organic products of the biocatalytic reaction, such as 2-hydroxybiphenyl compounds, can be easily separated from the reaction medium and sold as valuable products.

DETAILED DESCRIPTION OF THE INVENTION

The features and other details of the apparatus and method of the invention will now be more particularly described and pointed out in the claims. It will be understood that the particular embodiments of the invention are shown by way of illustration and not as limitations of the invention. The principle features of this invention can be employed in various embodiments without departing from the scope of the invention.

This invention is based on the discovery that the sulfur compounds in fossil fuels are complexed, prior to the metabolizing or catabolizing step. The invention exploits the complexing step to efficiently and selectively remove the contaminating sulfur compounds from a sulfur-rich fossil fuel, such as petroleum.

The term "sulfur compound" generally refers to any sulfur containing molecule which complexes with the selected biosorption agent. A biosorption agent may complex with one or more of the same or different sulfur compounds. As discussed above, sulfur is present in fossil fuels in the inorganic and organic state. Of particular interest is the removal of organic sulfur compounds which are known to be refractory to conventional hydrodesulfurization techniques, U.S. Pat. Nos. 5,002,888, 5,104,801 and 5,198,341, incorporated herein by reference. Such compounds are generally of the family of compounds known as dibenzothiophenes (DBT).

Sulfur containing carbonaceous materials which may be desulfurized according to this invention include asphalt and, particularly, fossil fuels such as petroleum, petroleum distillate fractions, coal derived liquids, shale oil, bitumens, gilsonite and tars and mixtures thereof, particularly petroleum and petroleum distillate fractions as well as synthetic fuels derived therefrom.

Biosorption agents which complex with sulfur compounds found in fossil fuels can be employed in this invention. As illustrated below, biosorption agents have now been found in microorganisms active for the desulfurization of fossil fuels and other organic carbonaceous material. The complexing step has been discovered to precede the sulfur removal steps. The biosorption agent may be the same or different biomaterial from the biocatalyst employed herein.

Many microorganisms are known in the art which remove sulfur from organic carbonaceous materials. Preferred are the class of microorganisms which metabolize or otherwise degrade DBT. Particularly preferred are the microorganisms described in U.S. Pat. Nos. 5,002,888, 5,104,801, 5,198,341, Kim et al., "Degradation of organic sulfur compounds and the reduction of dibenzothiophene to biphenyl and hydrogen sulfide by *Desulfovibrio desulfuricans* M6," 12 *Biotech . Lett.* (No. 10) pp. 761–764 (1990); and Omori et al., "Desulfurization of dibenzothiophene by *Corynebacterium sp.* strain SY1," 58 *Appl. Env. Microbiol.* (No. 3) pp. 911–915 (1992), all incorporated by reference. Particularly preferred microorganisms are *Rhodococcus rhodochrous* ATCC No. 53968 (IGTS8) and *Bacillus sphaericus* ATCC No. 53969. These microorganisms have the additional advantage of removing thiophenic sulfur from sulfur-bearing heterocycles, such as DBT, leaving the hydrocarbon framework thereof substantially intact. As a result, the fuel value of substrates exposed to BDS treatment does not deteriorate, as does the fuel value of a substrate exposed to other microorganisms. As disclosed in U.S. Pat. No. 5,104,801, this mutant is active for desulfurization when grown on organic sulfur sources, such as DBT and dimethyl sulfoxide (DMSO). The bacterium is found to be inactive or has reduced activity if grown in the presence of sulfate.

Microorganisms which can be employed in the claimed invention may also be made recombinantly, wherein DNA encoding the protein, enzyme or enzymes responsible for the complexing and/or desulfurization step has been transfected into a host cell. One such microorganism is that described in U.S. Ser. Nos. 07/911,845 and 08/089,755, pending, both of which are incorporated herein by reference. A preferred microorganism described therein is a *Rhodococcus rhodochrous* wherein DNA encoding the desulfurization enzymes was reintroduced. The microorganism is called RA18.

It is not required that living microorganisms be used. With certain suitable microorganisms, such as those particularly preferred as described above, the enzyme responsible for biocatalytic cleavage of carbon-sulfur bonds is present on the exterior surface of the cell envelope of the intact microorganism. Thus, non-viable microorganisms, such as heat-killed, can be used as a carrier for the biosorption agent and/or biocatalyst.

The biosorption agent of the claimed invention can also include the enzyme or enzymes responsible for the desulfurization biocatalytic reaction or any biosorption active fraction of the microorganism or any combination thereof.

In general, enzymes are protein catalysts made by living cells. Enzymes promote, direct, or facilitate the occurrence of a specific chemical reaction or series of reactions, which is referred to as a pathway, without themselves becoming consumed or altered as a result thereof. Enzymes can include one or more unmodified or post-translationally or synthetically modified polypeptide chains or fragments or portions thereof with or without any coenzymes, cofactors, or coreactants which collectively carry out the desired reaction or series of reactions. Biosorption agents and/or biocatalytic enzyme preparations that are useful in the present invention include microbial lysates, extracts, fractions, subfractions, or purified products obtained by conventional means and capable of carrying out the desired biocatalytic function. U.S. Pat. No. 5,132,219, and U.S. Ser. No. 07/897,314, pending, filed by Monticello et al. (Jun. 11, 1992), which are incorporated by reference herein, disclose suitable enzyme preparations.

The biosorption agent is preferably immobilized. As set forth above, the non-viable microorganism may serve as the carrier for the biosorption agent. Other types of carriers can also be used for the present enzyme, such as a membrane, filter, polymeric resin, diatomaceous material, glass particles or beads, ceramic particles or beads or other common supports.

The term "complex" is defined herein as any sulfur compound attached, bound, absorbed or adsorbed on or in a biosorption agent, such as a cell or enzyme. While it is believed that the mechanism of action is adsorption, it is not intended that the invention be so limited.

As set forth above, the sulfur-containing fossil fuel is contacted with the biosorption agent, wherein the sulfur compounds present in the fossil fuel complex with the agent. The complex formed is, preferably, insoluble or substantially insoluble in the fossil fuel. By "insoluble", it is meant that at least a portion of the complex can be removed from the fossil fuel by separation techniques such as settling, filtering or centrifugation. Most preferably, the complex is solid, while the fossil fuel is liquid. The sulfur-biosorption complex is then removed from the fossil fuel. The treated fossil fuel then has a reduced sulfur content.

Inasmuch as the complexing step is, generally, a step which precedes a biocatalytic reaction of the sulfur compound, the conditions of the complexing step are generally chosen to limit any biocatalytic reaction. For example, where the biocatalytic reaction is oxidative, such as that employing *Rhodococcus rhodochrous*, the complexing step can be achieved in the substantial absence of oxygen. The temperature and pH also can be manipulated to permit complexing but deter biocatalytic reaction. For example, preferred temperatures for the complexing step are in the range of between about 15° and 30° C.

The complexing step preferably occurs in the substantial absence of water. As a result, the fossil fuel stream is not contaminated with an aqueous stream, requiring costly separation techniques. Some microorganisms and enzymes may require a small amount of water to maintain viability or an effective configuration. In such instances, the water content is preferably maintained at the lowest concentration practicable, such as that amount sufficient to wet the biosorption agent.

The complexing and separating steps can be accomplished in a batch, semi-batch or continuous process or combination thereof. A preferred embodiment employs a continuous process. Where a continuous process is performed, the fossil fuel and biosorption agent streams can run co- or countercurrently, preferably countercurrently.

The separated sulfur-biosorption complex can then be discarded or, preferably, subjected to conditions which "release" the biosorption agent and substrate. Preferably, the separated sulfur-biosorption complex is introduced to a reaction medium, e.g. an aqueous phase, and conditions conducive to biocatalytic reaction.

In some embodiments, the biocatalyst may differ from the biosorption agent. In such an instance, it is preferred that a biocatalyst be added to the reaction medium. Suitable biocatalysts are discussed above and include microorganisms which remove sulfur from organic carbonaceous materials, any active fraction or enzyme or enzymes thereof.

Additional biocatalysts may also be added at this point in time to enhance the biocatalytic reaction. This would be appropriate, for example, where the biocatalyst of the complexing step does not possess the entire profile of enzymes required for the biocatalytic degradation of the sulfur compounds. By way of specific example, the biochemical pathway of the oxidation of DBT to 2-hydroxybiphenyl is thought to occur in 4 stages. It is believed that several enzymes are responsible for the entire pathway. The complexing step could be performed by a recombinant host, for example, transformed with DNA encoding a protein responsible for biosorption or an enzyme responsible for the first step. The reaction step would preferably take place in the presence of a recombinant host transformed with DNA encoding the remaining enzymes required for the pathway, the enzymes per se, the parent cell or any combination thereof.

The aqueous phase can be water taken alone or in combination with one or more suitable solvents, including oil or organic solvents, miscible or immiscible with water. The choice of solvent is, generally, within the skill in the art. The reaction medium, where it consists of two phases, preferably forms an emulsion or microemulsion. In such an embodiment, the organic product of the reaction would, generally, pass to the organic phase while the inorganic sulfur compound would remain in the aqueous phase.

The reaction medium so obtained is then, preferably, incubated for a sufficient period of time to permit biocatalytic reaction. The term "incubating" is defined as exposing the reaction substrate to the biocatalyst under conditions suitable for reaction.

In some embodiments of the claimed invention, the biocatalytic reaction of the sulfur compound is oxidative. In such instances, oxygen should be added to the reaction medium in an amount effective for oxidizing the compound. The oxygen can be added in any suitable form, such as air, oxygen enriched air or oxygen gas. The oxygen can be added to the aqueous stream prior to or during the addition of the complex or the reaction step.

The contact of the biosorption agent and/or biocatalyst with the fossil fuel may be deleterious to the biocatalyst. Thus, a preferred embodiment of the claimed invention is where the reaction medium also contains nutrients and/or other additives to encourage cellular repair for the biosorption agent and/or biocatalyst. This has the advantage of rejuvenating the biomolecule prior to or during the biocatalytic reaction and extending the life and effectiveness of the biomolecule. Nutrients and other additives which may be added include coenzymes, cofactors, or coreactants of the cells or enzymes. Examples of suitable nutrients are disclosed in U.S. Pat. No. 5,104,801, incorporated herein by reference.

The reaction medium is then incubated under effective conditions for a sufficient period of time to produce an organic product, an inorganic sulfur and the biocatalyst. Preferably, the temperature is in the range of about 30° and 40° C. Preferably, the pH is about 5 to about 9.

The products of the reaction can then be isolated by known methods. For example, an immobilized biocatalyst can be removed from the reaction medium by any known liquid/solid separation technique, including settling, filtration and centrifugation. The biosorption agent and/or biocatalyst so removed can then be recycled. The organic product can be removed from the aqueous phase by conventional methods as well, including extraction, recrystallization, membrane separations or distillation. The organic product can be sold as a valuable chemical or returned to the fossil fuel stream. The remaining aqueous phase rich in inorganic sulfur can, optionally, be concentrated or isolated and then discarded or sold.

It is known that *Rhodococcus rhodochrous*, and other microorganisms described herein, degrade DBT compounds to 2-hydroxybiphenyl and derivatives thereof, as disclosed in U.S. Pat. No. 5,104,801, for example. However, the teachings therein do not disclose or suggest that the compound so obtained can be isolated from the fossil fuel by the multi-step process of this invention. Thus, an added advantage of the claimed invention is the preparation of the 2-hydroxybiphenyl compounds wherein the sulfur compound within the fossil fuel are DBT derivatives.

The biosorption of this invention could also have applicability in the denitrification of fossil fuels as well as the removal of other undesirable materials (metals, for example). Appropriate biosorption agents selective for nitrogen compounds or metals can be developed. Employing the methods of the disclosed invention, these agents can be used for the removal of unwanted nitrogen compounds and/or metals.

The invention will now be described more specifically by the following examples.

EXAMPLE 1

Complexing Radiolabeled DBT in Radiolabeled Hexadecane with ATCC 53968 and RA18

A dibenzothiophene/hexadecane solution is a recognized model for evaluating desulfurization technologies. DBT is a recognized representative of organic sulfur molecules in middle distillate hydrocarbon streams.

A solution of approximately 0.3 weight percent (16.3 mM/l) of $^{3}H$ radio-labeled dibenzothiophene in $^{14}C$ radio-labeled hexadecane was formed, and the $^{3}H$:$^{14}C$ ratio was measured. Approximately 1 ml of the dibenzothiophene solution was mixed with 9 ml of a water solution and a known amount of cells. After a contact time of 2 hours at 20° C., the mixture was centrifuged to remove the cells and to separate the oil and water phases. The $^{3}H$:$^{14}C$ ratio in the hydrocarbon phase was again measured. Where the ratio of $^{3}H$:$^{14}C$ ratio remains the same, the cells exhibit no affinity for DBT (no complexing) or no affinity for DBT over hexadecane (no complexing specificity). A decrease in the $^{3}H$:$^{14}C$ ratio indicates that the cells have a specific affinity for DBT. An increase in the $^{3}H$:$^{14}C$ ratio indicates the cells have a specific affinity for hexadecane over DBT. In all the experimental runs, cells active for desulfurization (ATCC 53968 cells or recombinant *Rhodococcus rhodochrous*, RA18 cells, grown on DMSO) bound to DBT, indicated by reduced $^{3}H$:$^{14}C$ ratios. The data for two experimental runs, including the hydrocarbon phase DBT concentration, in millimoles per liter (mM/l), are listed in Table 1.

TABLE 1

| | $^{3}H$:$^{14}C$ ratio | DBT (mM/l) |
|---|---|---|
| Run 1 | ATCC 53968 (1 g) | |
| Initial | 4.92 | 16.3 |
| After Contact | 3.06 | 10.7 |
| % Reduction of DBT | | 34.4 |
| Run 2 | RA18 (2 g) | |
| Initial | 4.39 | 16.3 |
| After Contact | 0.63 | 2.2 |
| % Reduction of DBT | | 86.4 |

In both cases, a substantial portion of the DBT was removed from the organic phase as a complex with the biosorption agent.

EXAMPLE 2

Complexing DBT in Hexadecane with RA18

Example 1 was repeated except DBT and hexadecane were substituted for the radio-labeled compounds. Two grams of RA18 were employed. The organic phase was analyzed by gas chromatography. In that experiment, DBT was reduced from about 0.286 weight per cent (about 15.6 mM/l) to zero in about 2 hours. This experiment also demonstrated that DBT was removed from the organic phase as a complex with the biosorption agent.

EXAMPLE 3

Comparative Example Employing Cells Inactive for Desulfurization

Example 1 was repeated except 2 grams of the microorganisms employed were ATCC 53968 grown on sulfate as its sulfur source (known in the art as being inactive as a desulfurization biocatalyst), GPE362 (a variety of *Rhodococcus rhodochrous* where the DNA encoding the desulfurization enzymes were deleted, grown on DMSO), killed fungal and killed yeast cells were tested for general adsorptive behavior. These cells were not active for desulfurization.

The results obtained are shown in Table 2.

TABLE 2

| Cells | ATCC 53968 (sulfate grown) | GPE362 (run 1) | GPE362 (run 2) | Yeast | Fungal |
|---|---|---|---|---|---|
| Initial (mM/l) | 16.3 | 16.3 | 16.3 | 16.3 | 16.3 |
| After Contact (mM/l) | 15.1 | 15.9 | 14.2 | 16.2 | 14.6 |
| % Reduction of DBT | 7.4 | 2.5 | 12.9 | 0.6 | 10.4 |

None of these cells, sulfate grown ATCC 53968, GPE362, yeast and fungal, complexed with DBT to any significant extent.

The data demonstrate that a specific complexing for DBT is exhibited by desulfurization positive cells, RA18 and IGTS8 cells grown on DMSO, (Table 1) but is not exhibited by GPE362, ATCC 53968 grown on sulfate, or by yeast or fungal cells (cells known in the art incapable of desulfurizing DBT). It can, therefore, be concluded that removal of DBT from the organic phase is not due to aqueous solubility which should not be altered by the presence or absence of cells, but due to complexing of DBT with cells possessing the ability to desulfurize carbonaceous materials.

EXAMPLE 4

Complexing DBT with RA18

Example 1 was repeated, employing 0.2 g and 2.0 g of RA18 cells. The concentration of DBT was measured at 30 min. intervals. The data is set forth in Table 3.

TABLE 3

| Time | RA18 (0.2 g) DBT (mM/l) | RA18 (2 g) DBT (mM/l) |
|---|---|---|
| 0 min. | 16.3 | 16.3 |
| 30 | 14.8 | 11.4 |
| 60 | 13.6 | 8.5 |
| 90 | 12.6 | 6.3 |
| 120 | 13.7 | 4.6 |
| 150 | 12.3 | 4.0 |
| 180 | 11.9 | 4.2 |
| 210 | 9.6 | 3.9 |

TABLE 3-continued

| Time | RA18 (0.2 g) DBT (mM/l) | RA18 (2 g) DBT (mM/l) |
|---|---|---|
| 240 | 9.1 | 3.5 |

This experiment demonstrates that complexing occurs as a function of time and cell concentration.

EXAMPLE 5

Complexing DBT with RA18

Example 1 was repeated employing various amounts of RA18 cells at temperatures of 20° C. and 30° C. for 2 hr.

TABLE 4

| | RA18 Cells | |
|---|---|---|
| Cells | 20° C. DBT (mM/l) | 30° C. DBT (mM/l) |
| 0.00 g | 16.3 | 16.3 |
| 0.05 | 15.6 | 16.0 |
| 0.10 | 14.3 | 15.6 |
| 0.20 | 13.4 | 14.5 |
| 0.50 | 7.5 | 11.7 |
| 1.10 | 3.4 | 7.6 |
| 1.50 | 2.4 | 6.5 |
| 2.00 | 2.2 | 6.7 |

This data indicates that the removal of DBT from the organic phase is proportional to the amount of desulfurization positive cells present and is enhanced at lower temperatures. These results are consistent with and support complexing with the biosorption agent as the mechanism for removal of DBT from the organic phase.

EXAMPLE 6

Complexing DBT with Immobilized ATCC 53968

The Cytolift Bioreactor employed in this example is characterized by a means located near the bottom of the reactor for feeding the appropriate solution into the reactor, an air valve for providing an oxygen source, if desired, a means located near the top of the reactor for removing the effluent from the reactor, a tube which removes the effluent and places it into a collection flask, a tube which feeds from the flask through a peristaltic pump and back into the reactor at the feeding means.

Immobilization of ATCC 53968 on Glass Beads: ATCC 53968 (10 ml turbid suspension in sterile Basal Salt medium (BSM)) was incubated at 30° C. for at least 3 hours in a 1000 ml BSM, 6.4 ml glycerol, 25 ml glucose (20%) and 40 mg DBT in a 2 l flask. The flask was then filled with Manville Beads and permitted to sit for at least 3 hr. The excess liquid was poured off, leaving immobilized cells. The cells were added to a the bioreactor (Kontes).

A solution of 600 ml BSM, 15 ml 20% glucose, 3.84 ml glycerol and 169.80 μl DMSO was made. Two hundred fifty ml of this solution was added to the bioreactor, where the immobilized cells were allowed to reproduce. The remaining BSM solution (approx. 350 ml) was added to the collection flask. The air valve was then opened and the peristaltic pump was turned on. The reactor ran for 71 hrs. at room temperature.

Absorption monitoring: The BSM solution was then changed to a 3 wt % solution of DBT in hexadecane. Two hundred fifty ml of the DBT solution was added to the reactor and 350 ml added to the collection flask. The solution was sampled every 24 hrs and the concentration of sulfur was measured.

TABLE 5

| Time (hrs) | Sulfur Content | % Sulfur Reduction |
|---|---|---|
| 0 | 0.515 | |
| 24 | 0.494 | 4.08% |
| 48 | 0.484 | 6.02% |
| 72 | 0.478 | 7.18 |
| 96 | 0.466 | |
| 96* | 0.466 | 9.51% |
| 166 | 0.455 | |
| 166* | 0.463 | 10.10% |

*The sample was washed with a $Na_2HPO_4$ pH 7.0 solution

This experiment shows that immobilizing the biosorption agent also results in an effective complexing process.

EXAMPLE 7

Two Stage BDS (Adsorption - Conversion)

One hundred and twenty-five ml of 0.05M phosphate buffer at pH 7.5 was added to a 1 L reaction vessel. The cell loading in the aqueous phase was 100 g biocatalyst/l and the volume of aqueous phase added included the volume of the suspended cells. A cell slurry was prepared by adding 600 g of DMSO grown (desulfurization positive) RA18 cells to 5400 ml of 0.05M phosphate buffer at pH 7.5. Once the slurry was prepared 125 ml of the slurry was added to the 1 L reactor. After the slurry is added 375 ml of hexadecane+3 wt. % DBT was added to the reactor. The remaining slurry was placed in a cell reservoir and approximately 650 ml of the hexadecane+3 wt. % DBT was added to the oil reservoir. The air rate was set to 200 sccm on the reactor 1 and the program controlling the two inlet pumps, outlet pump, and the mixing motor was initiated. The flowrates were set at 6.25 ml/min for the inlet oil and 2.083 ml/min for the cell slurry. For 500 ml of reactor volume this provided a 1 hour residence time in the reactor 1. The emulsion was collected from the outlet emulsion pump at a rate of 8.333 ml/min every 25 minutes and centrifuged at 12,000 rpm. After the emulsion was separated in the centrifuge the oil was withdrawn and returned to the oil reservoir. The separated water was discarded and the cell pellet was resuspended with a homogenizer and 100 ml of phosphate buffer. This suspension was then placed in reactor 2 with the air rate set at 400 sccm and the mixing at 1700 rpm. Samples were taken from the recycled oil phase in reactor 1 and the aqueous phase in reactor 2. The samples were analyzed for DBT and 2-hydroxybiophenyl (2-HBP, the desulfurization product) and the results are shown in Table 6 and 7 below.

TABLE 6

| Reactor 1 GC analysis of the oil phase | | | |
|---|---|---|---|
| Time (hour) | DBT (wt. %) | 2-HBP (wt. %) | Sulfur-GC (wt. %) |
| Stock | 2.895 | ND | 0.50 |
| 1.25 | 2.916 | ND | 0.51 |
| 2 | 2.887 | ND | 0.50 |
| 3 | 2.838 | ND | 0.49 |
| 4 | 2.873 | ND | 0.50 |
| 5 | 2.874 | ND | 0.50 |
| 7 | 2.779 | ND | 0.48 |

TABLE 6-continued

| Reactor 1 GC analysis of the oil phase | | | |
|---|---|---|---|
| Time (hour) | DBT (wt. %) | 2-HBP (wt. %) | Sulfur-GC (wt. %) |

ND = not detectable. Detection limit is 0.002 wt. % for 2-HBP

TABLE 7

| Reactor 2 HPLC Analysis of the Aqueous Phase | | |
|---|---|---|
| Time (hour) | DBT (μg/ml) | 2-HBP (μg/ml) |
| 2 | 7.58 | 12.19 |
| 3 | 46.05 | 9.88 |
| 4 | 16.74 | 11.49 |
| 5 | 24.7 | 15.06 |
| 7.5 | 23.08 | 22.98 |
| 26 | 0.69 | 25.95 |
| 51 | 3.37 | 30.50 |
| 70 | 25.56 | 40.34 |

These results indicate that the adsorption of DBT and conversion can be separated into two reaction steps: 1. A relatively rapid adsorption step. 2. A conversion of the adsorbed DBT to 2-HBP.

EXAMPLE 8

Two Stage BDS (Adsorption - Conversion) With Oxygen Free Adsorption Step

The experiment described in Example 7 was repeated except that reactor 1 was sparged with 400 sccm of 99+% nitrogen. The results from GC analysis of the oil phase from reactor 1 and HPLC analysis of the aqueous phase from reactor 2 are shown in Table 8 and 9 respectively.

TABLE 8

| Reactor 1 GC Analysis of the Oil Phase | | |
|---|---|---|
| Time (hour) | DBT (wt. %) | 2-HBP (wt. %) |
| stock | 2.938 | ND |
| 1 | 2.902 | ND |
| 2 | 2.912 | ND |
| 3 | 2.880 | ND |
| 4 | 2.897 | ND |
| 5 | 2.878 | ND |
| 6 | 2.862 | ND |
| 7 | 2.845 | ND |

ND = not detectable. Detection limit is 0.002 wt. % for 2-HBP

TABLE 9

| Reactor 2 HPLC Analysis of the Aqueous Phase | | |
|---|---|---|
| Time (hour) | DBT (μg/ml) | 2-HBP (μg/ml) |
| stock | ND | ND |
| 1 | 11.8 | 6.77 |
| 2 | 7.51 | 7.76 |
| 3 | 6.55 | 11.84 |
| 4 | 9.10 | 12.14 |
| 5 | 11.53 | 15.49 |
| 6 | 7.03 | 17.72 |

ND = not detectable. Detection limit is 0.5 μg/ml for 2-HBP

These results indicate that the adsorption step can be accomplished in an oxygen-free system while the second conversion step takes place in an oxygen-sparged and aqueous system.

EQUIVALENTS

Those skilled in the art will recognize, or be able to ascertain using no more than routine experimentation, many equivalents to the specific embodiments of the invention described specifically herein. Such equivalents are intended to be encompassed in the scope of the claims.

We claim:

1. A method of separating a sulfur compound from a fossil fuel containing sulfur compounds, comprising the steps of:

a) contacting said fossil fuel with a biosorption agent which binds said sulfur compound, thereby forming a sulfur-biosorption complex;

b) separating said sulfur-biosorption complex from the fossil fuel;

c) introducing said separated sulfur-biosorption complex to an aqueous phase having an effective amount of oxygen and water to form a reaction medium, optionally adding a biocatalyst which degrades the sulfur compound; and d) incubating the medium for a sufficient period of time under conditions which allow further reaction between the biosorption agent and/or the biocatalyst and the sulfur compound to produce an organic product and an inorganic sulfur.

2. A method of claim 1 further comprising the step of:

e) isolating said biosorption agent and/or biocatalyst from said organic product and said inorganic sulfur.

3. A method of claim 1 wherein the biosorption agent binds an organic sulfur compound.

4. A method of claim 1 wherein the biosorption agent is a microorganism having the sulfur degradation characteristics of *Rhodococcus rhodochrous* ATCC No. 53968, an enzyme or an extract thereof.

5. A method of claim 4 wherein the biosorption agent is *Rhodococcus rhodochrous* ATCC No. 53968.

6. A method of claim 4 wherein the biosorption agent is immobilized.

7. A method of claim 4 wherein the biosorption agent is an enzyme or an active fraction of *Rhodococcus rhodochrous* ATCC No. 53968 which complexes with sulfur compound.

8. A method of claim 4 wherein the fossil fuel is petroleum.

9. A method of claim 7 wherein the fossil fuel is a petroleum distillate fraction.

10. A method of claim 4 wherein step a) occurs essentially in the absence of water.

11. A method of claim 4 wherein step a) occurs essentially in the absence of oxygen.

12. A method of claim 7 wherein nutrients are also added to step c).

13. A method of claim 12 wherein the biosorption agent and/or biocatalyst is recycled.

14. A method for separating an organic sulfur compound from a petroleum containing organic sulfur compounds, comprising the steps of:

a) contacting said petroleum with an immobilized biosorption agent which binds said sulfur wherein the biosorption agent is a microorganism having the biocatalytic sulfur degradation characteristics of *Rhodococcus rhodochrous* ATCC No. 53968, an enzyme or an active fraction thereof, essentially in the absence of water and oxygen, thereby forming an sulfur-biosorption complex;

b) separating said sulfur-biosorption complex from the petroleum;

c) introducing said separated sulfur-biosorption complex to an aqueous phase having an effective amount of oxygen and water to form a reaction medium;

d) incubating the medium for a sufficient period of time under conditions which allow reaction between the biocatalyst and the sulfur compound to produce an organic product, an inorganic sulfur and spent biocatalyst; and e) isolating said biosorption agent/biocatalyst from said organic product and said inorganic sulfur.

15. A method of claim 14 wherein nutrients are also added to step c).

16. A method of claim 15 wherein the biosorption agent/biocatalyst is recycled.

17. A method of claim 3 wherein the biosorption agent is a biocatalyst capable of desulfurizing a fossil fuel.

* * * * *

UNITED STATES PATENT AND TRADEMARK OFFICE

CERTIFICATE OF CORRECTION

PATENT NO. : 5,468,626

DATED : November 21, 1995

INVENTOR(S) : Steven W. Johnson, Daniel J. Monticello, Phillip R. Gibbs and Charles F. Kulpa

It is certified that error appears in the above-identified patent and that said Letters Patent is hereby corrected as shown below:

On the cover page, under Assignees [73], after "University of Notre Dame" delete "Notre Dam" and insert therefor --Notre Dame--;

In Column 12, line 1, delete "Claim 4" and insert therefor --Claim 7--; and

In Column 12, line 9, delete "Claim 7" and insert therefor --Claim 4--.

Signed and Sealed this

Twentieth Day of February, 1996

*Attest:*

Bruce Lehman

BRUCE LEHMAN

*Attesting Officer*

*Commissioner of Patents and Trademarks*